US008276799B2

(12) United States Patent
Chen

(10) Patent No.: US 8,276,799 B2
(45) Date of Patent: Oct. 2, 2012

(54) FRONT-DEPRESSION STAPLING DEVICE

(75) Inventor: Ton-Yi Chen, Taichung (TW)

(73) Assignee: Jann Yei Industry Co., Ltd., Taichung (TW)

( * ) Notice: Subject to any disclaimer, the term of this patent is extended or adjusted under 35 U.S.C. 154(b) by 118 days.

(21) Appl. No.: 12/772,239

(22) Filed: May 3, 2010

(65) Prior Publication Data

US 2011/0089217 A1 Apr. 21, 2011

(30) Foreign Application Priority Data

Oct. 21, 2009 (TW) ..... 98135579 A

(51) Int. Cl.
*B25C 1/02* (2006.01)

(52) U.S. Cl. ..... 227/129; 227/146

(58) Field of Classification Search ..... 227/129, 227/132, 146, 156
See application file for complete search history.

(56) References Cited

U.S. PATENT DOCUMENTS

| | | | | |
|---|---|---|---|---|
| 5,328,075 | A * | 7/1994 | Marks | 227/132 |
| 5,664,722 | A * | 9/1997 | Marks | 227/132 |
| 6,789,719 | B2 * | 9/2004 | Shor | 227/132 |
| 7,097,088 | B2 * | 8/2006 | Shor | 227/132 |
| 2007/0145094 | A1 * | 6/2007 | Chou | 227/132 |

* cited by examiner

*Primary Examiner* — Rinaldi Rada
*Assistant Examiner* — Nathaniel Chukwurah
(74) *Attorney, Agent, or Firm* — Leong C. Lei

(57) ABSTRACT

A stapling device includes a device body to which a depressing bar is pivotally mounted. Through a link plate, the depressing bar selectively drives a staple striking assembly downward for striking out staples. The depressing bar has a depressing end that is located at the same side as the portion of the device body where the staple striking assembly is mounted. The link plate has an end to which a lifting member that selectively engages and lifts the staple striking assembly is mounted. . . . The staple striking assembly includes a guide board that can be set in engagement with and thus driven by the lifting member. The staple striking assembly, when lifted to a predetermined height level, is released to strike out staples and the lifting member is caused to transversely shift to allow for the instantaneous downward movement of the staple striking assembly for striking out staples.

10 Claims, 11 Drawing Sheets

FRONT-DEPRESSION STAPLING DEVICE

(a) TECHNICAL FIELD OF THE INVENTION

The present invention generally relates to a stapling device, and more particularly to a stapling device that is actuated by depressing a front end of a device body in order to make the operation smooth and reliable and performance improved.

(b) DESCRIPTION OF THE PRIOR ART

Structurally, a manually operating stapling device comprises a device body to which a downward depressible depressing bar is pivotally mounted. The depressing bar selectively engages and lifts a staple striking plate. Conventionally, to allow the depressing bar to engage and lift the staple striking plate, the depressing bar is often set to have a lower end thereof at the side of the device body that is opposite to where staples are struck out. (Since the position is on the rear side of the staple striking plate, it is often referred to as rear-depression type.) Such an arrangement will cause a staple outlet to be slightly raised in striking out a staple. This affects the stability and safety of the operation of the device.

Front-depression type stapling devices are also known, such as U.S. Pat. Nos. 5,407,118, 5,497,932, and 7,097,088. The location where depression is made is on the same side as the location where the staples are struck out. This avoids the problem of the staple outlet being raised upward. However, these known devices are of complicated structures, making the costs for manufacturing and assembling greatly raised. Further, these devices use a linking member to drive a staple striking plate, but the linking member is either movable frontward/rearward or driven leftward/rightward for releasing, after a staple was struck out. The alignment in position is poor, leading to unsmooth operation of releasing, and this in turn affects the reliability of staple striking operation. Thus, further improvement is needed in this respect.

The present invention aims to provide front-depression stapling device which offers benefits in the respects of operation safety, operation stability, operation convenience, action reliability, and action smoothness, so as to overcome the above discussed problems.

SUMMARY OF THE INVENTION

The present invention provides a front-depression stapling device that features smooth operation and reliable action. The stapling device comprises a device body to which a depressing bar is pivotally mounted. Through a link plate, the depressing bar selectively drives a staple striking assembly downward for striking out staples. The depressing bar has a depressing end that is located at the same side as the portion of the device body where the staple striking assembly is mounted. The link plate has an end to which a lifting member that selectively engages and lifts the staple striking assembly is mounted. The lifting member is selectively and transversely shifted with respect to the link plate in a returnable manner. The staple striking assembly comprises a guide board that can be set in engagement with and thus driven by the lifting member. The staple striking assembly, when lifted to a predetermined height level, is released to strike out staples and the lifting member is caused to transversely shift to allow for the instantaneous downward movement of the staple striking assembly for striking out staples. With such an arrangement, the depressing operation is carried out at the same side as staple striking, so that operation stability of the stapling device is greatly improved. Since the link plate uses the lifting member that is allowed to do transverse shifting and returning to lift the staple striking assembly, jamming that often occurs in the conventional stapling devices can be eliminated so that smoothness and reliability of the overall operation of staple striking are enhanced.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
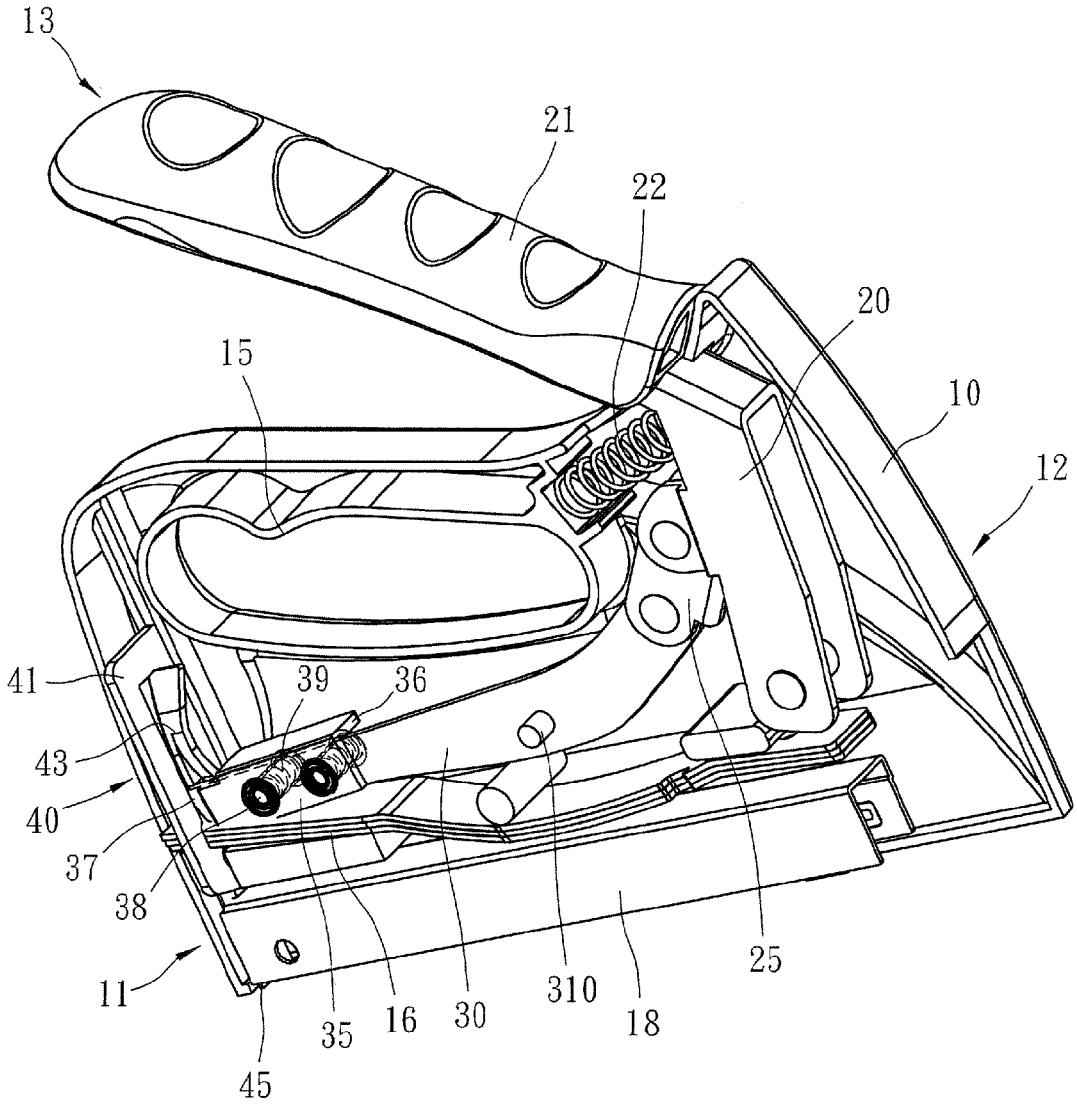
FIG. 1 is a perspective view, partially broken, showing a front-depression stapling device according to the present invention.

Referring to FIG. 1, a front-depression stapling device according to the present invention comprises a device body 10, a depressing bar 20 pivotally mounted to the device body 10, a link plate 30 driven by the depressing bar 20, and a staple striking assembly 40 that is liftable and releasable by the link plate 30.

Figure 2:
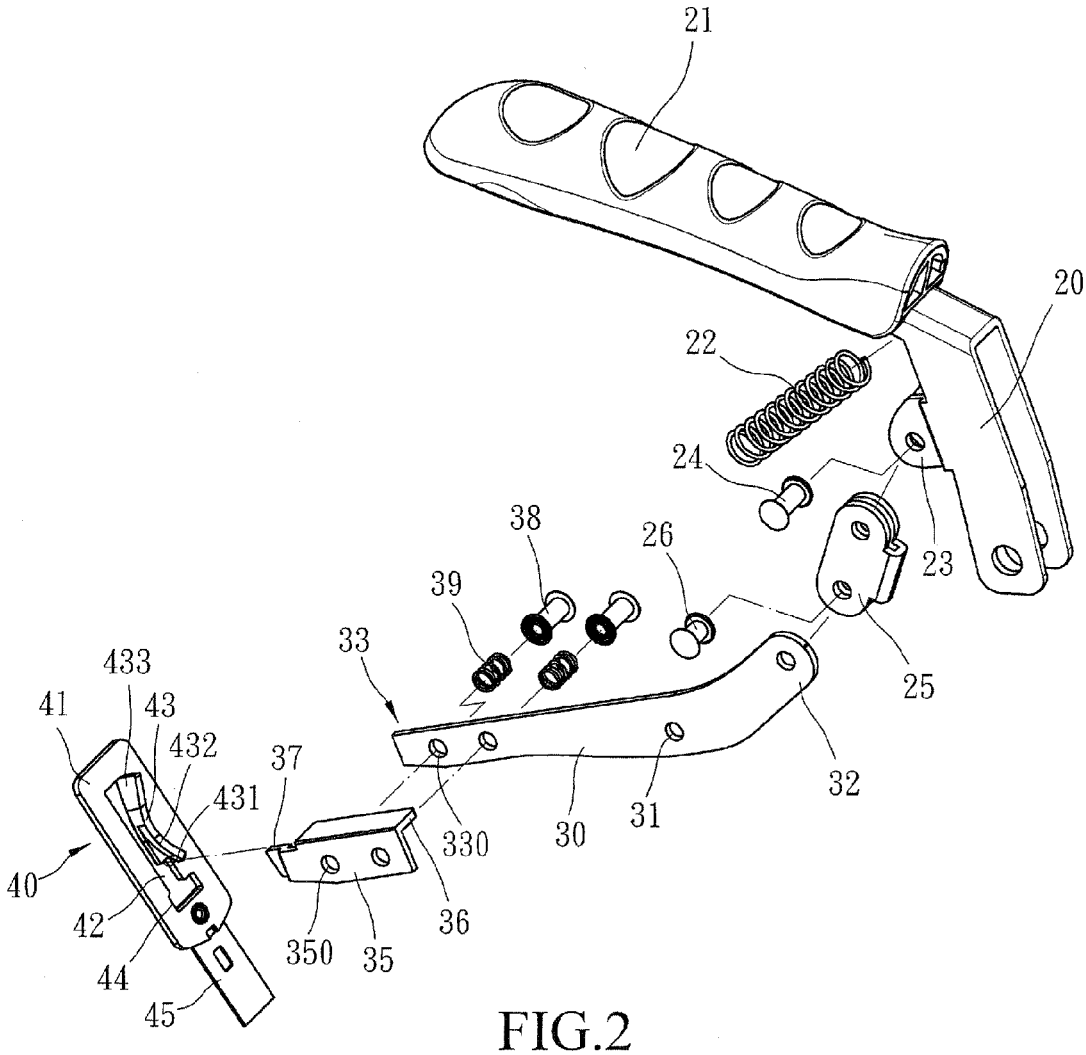
FIG. 2 is an exploded view showing spatial relationship among a depressing bar, a link plate, a lifting member, and a staple striking assembly of the stapling device according to the present invention.
Figure 4:
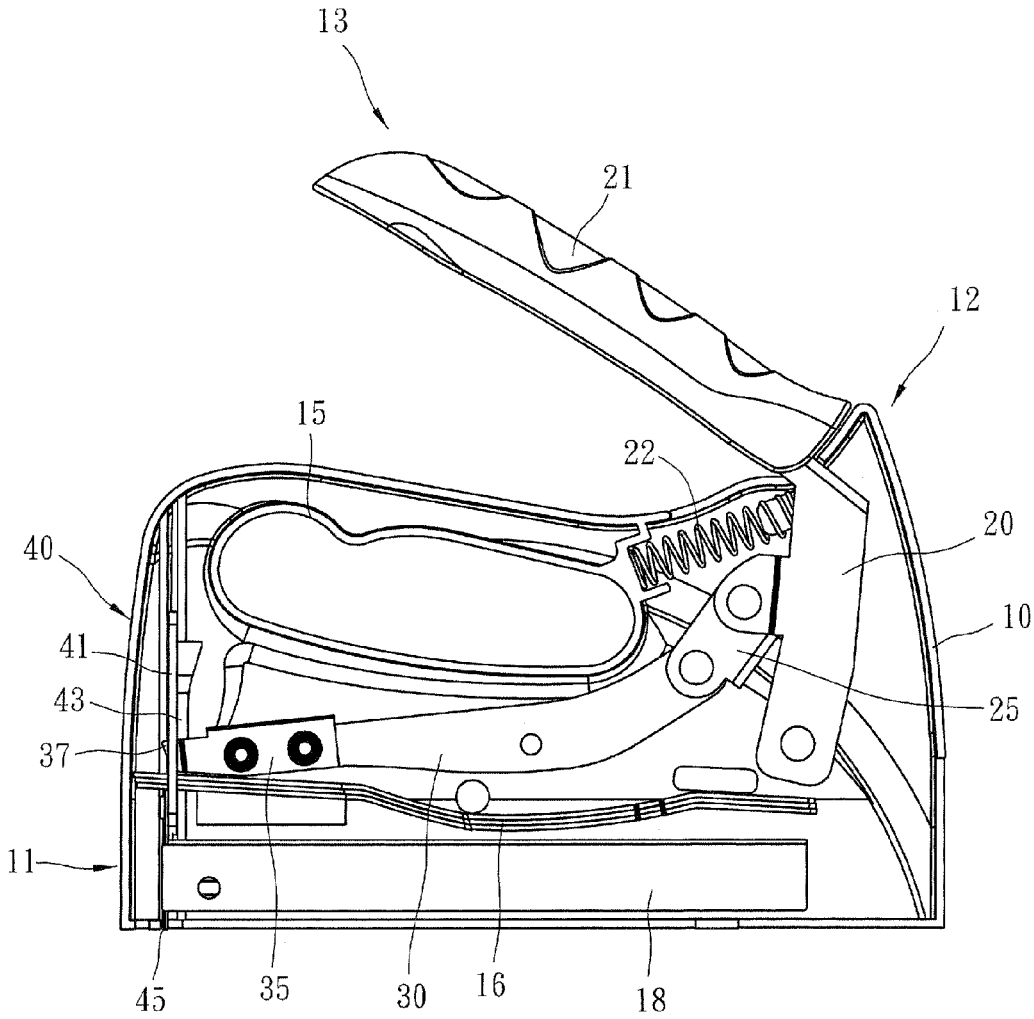
FIG. 4 is a cross-sectional view showing the depressing bar and the staple striking assembly of the stapling device in home positions.

As shown in FIGS. 1, 2, and 4, the device body 10 is composed of two casing members coupled to each other. The device body 10 has two ends respectively forming a staple striking end 11 and a coupling end 12. The depressing bar 20 is pivotally mounted at the coupling end 12, so that a free end of the depressing bar 20 forms a depressing end 13 at a location that is on the same side of and above the staple striking end 11. The device body 10 forms a handle 15 in an upper portion thereof and corresponding to the depressing end 13. The device body 10 has a lower portion in which a staple-striking spring plate 16 is set. The staple-striking spring plate 16 has a free end inserted into and engaging the staple striking assembly 40 for lifting upward the staple striking assembly 40 to induce a pre-loaded home-returning spring force that leads to a powerful downward strike. The lower portion of the device body 10 also receives therein a selectively removable and replaceable staple magazine 18 in which staples are loaded.

The depressing bar 20 has a top portion that forms a depressing section 21 extending toward the depressing end 13 in an upward inclined manner to allow for the actuation of depressing operation with respect to the device body 10. A resilient element 22 is arranged between an inner side of the depressing bar 20 and the device body 10 to provide a pre-loaded home-returning spring force after the depressing bar 20 is depressed. Further, the depressing bar 20 has a middle section forming a pivotal connection lug 23 and the pivotal connection lug 23 cooperates with a pivot pin 24 to pivotally connect a press-down seat 25. The press-down seat 25 has an opposite end that uses another pivot pin 26 to pivotally connect to the link plate 30.

Figure 3A:
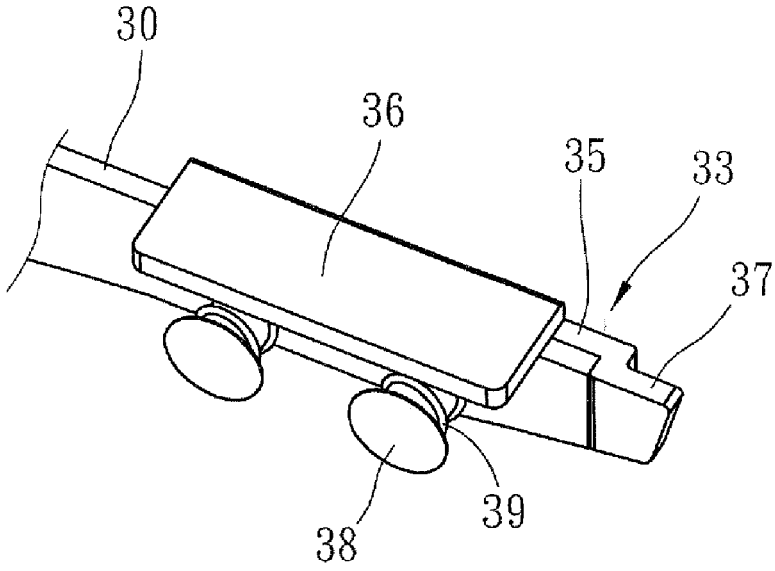
FIG. 3A is a perspective view showing the lifting member is in a home position with respect to the link plate.
Figure 3B:
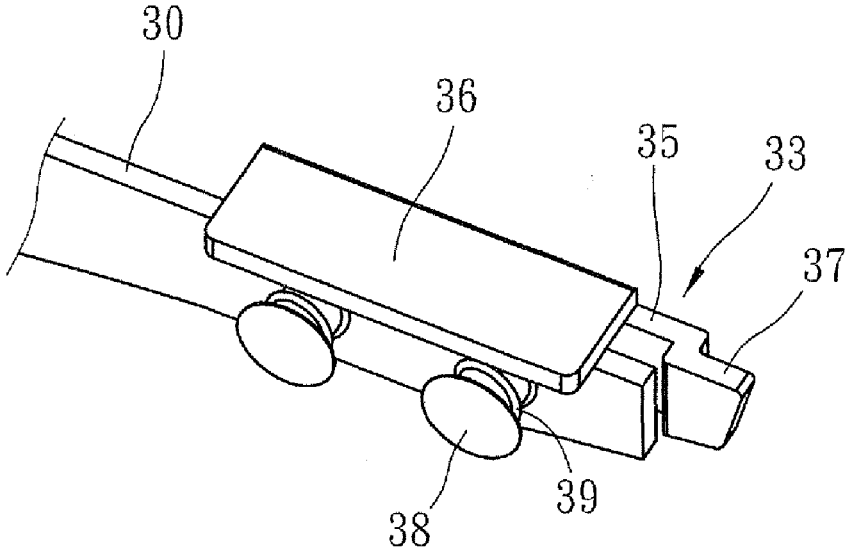
FIG. 3B is a perspective view showing the lifting member is in a transversely shifted position with respect to the link plate.

The link plate 30 has a middle section forming a pivot hole 31 that receives therein a shaft 310 to pivotally mount the link plate 30 to the device body 10. The link plate 30 has two ends respectively forming a pivoting end 32 and a coupling end 33, wherein the pivoting end 32 is pivotally connected to the press-down seat 25 by the pivot pin 26 and the coupling end 33 forms at least two through holes 330. Arranged at one side of the coupling end 33 is a lifting member 35 that can engage and thus move the staple striking assembly 40. The lifting member 35 forms through holes 350 corresponding to the through holes 330 for receiving guide rods 38 that have a length greater than the addition of the thickness of the link plate 30 and the lifting member 35. Each guide rod 38 is fit in a compression spring 39 at the side of the link plate 30 that is opposite to the lifting member 35, so that the lifting member 35 is allowed to move transversely to the opposite side (as shown in FIG. 3B) and return to a home position (as shown in FIG. 3A). Further, the lifting member 35 comprises a positioning tab 36 arranged on the coupling end 33 to make the movement of the lifting member 35 smoothened. The lifting member 35 has a front tip that is bent to form an engaging piece 37 substantially corresponding to an end face of the link plate 30, so that the operation of engaging and moving performed by the lifting member 35 can be carried out along the axis of the link plate 30, eliminating any potential lateral shifting and thus ensuring smooth and reliable engaging and moving operation.

The staple striking assembly 40 comprises an upper strike plate 41 that is vertically movable inside the staple striking end 11. The upper strike plate 41 forms a strike guide slot 42 that extends vertically along a central axis of the upper strike plate 41. On a side of the strike guide slot 42, sideways bending is made to form a guide board 43. The guide board 43 has a lower end forming an engaging end 431. The engaging end 431 can be set in engagement and driven by the engaging piece 37. The engaging end 431 is connected to a guide flange 432 that corresponds to the strike guide slot 42, so that when the staple striking assembly 40 is upward lifted to a predetermined height level and then released to strike a staple, the guide flange 432 guides the lifting member 35 for sideways shifting. The guide flange 432 is connected, at an upper end thereof, to a give-way flange 433, which helps eliminating any interference with the sliding movement of the engaging piece 37 inside the strike guide slot 42. The upper strike plate 41 forms a coupling hole 44 below the strike guide slot 42 and the coupling hole 44 receives a free end of the staple-striking spring plate 16 to insert therein. The upper strike plate 41 has a lower end to which a lower strike plate 45 that is selectively extendable out of a lower end of the device body 10 is mounted, whereby the lower strike plate 45 is operable to powerfully strike out staples loaded in the staple magazine 18.

As such, a front-depression stapling device featuring stable operation and reliable and smooth action is constructed.

As shown in FIGS. 1 and 4-11, the depressing bar 20 is acted upon by the resilient element 22 to return upward to the home position, while the staple striking assembly 40 is acted upon by the staple-striking spring plate 16 to return downward to the home position so as to have a lower end of the lower strike plate 45 extending out of the lower end of the device body 10 to allow the staples loaded in the staple magazine 18 to automatically move frontward and abut against a surface of the lower strike plate 45 (not shown). Meanwhile, the link plate 30 is driven downward by the staple striking assembly 40 and the engaging piece 37 is positioned against a bottom of the engaging end 431.

Figure 5:
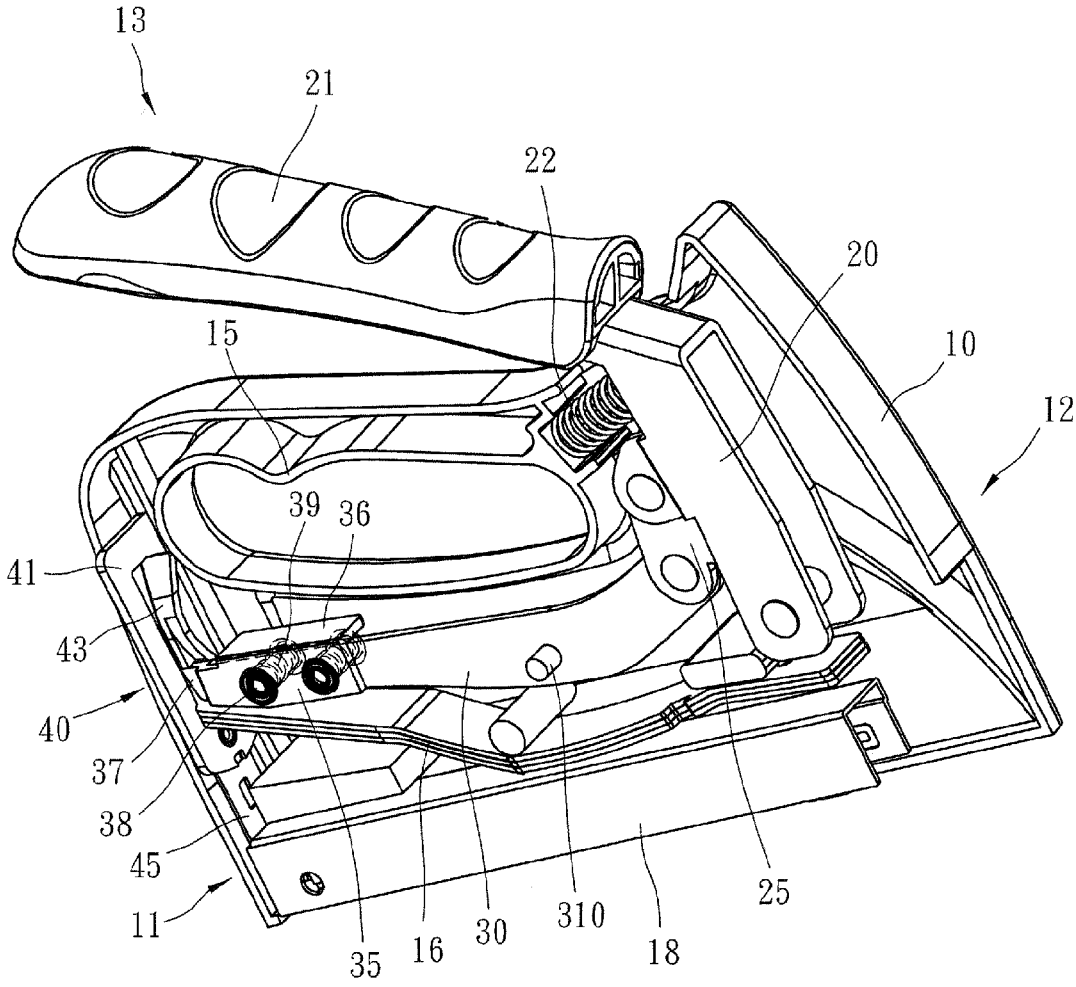
FIG. 5 is a perspective view, partially broken, showing the depressing bar and the staple striking assembly of the stapling device in home positions.

To strike out the staples, as shown in FIG. 5, an operator uses a hand to hold the handle 15 and positions the lower end of the device body 10 flat against a surface of a work piece (not shown). Then, the operator uses the palm to depress the depressing section 21 down toward the device body 10, whereby through the press-down seat 25, the depressing bar 20 depresses the pivoting end 32 down, making the lifting member 35 upward raised. Since the engaging piece 37 is positioned against the bottom of the engaging end 431, the link plate 30 can use the lifting member 35 to lift the staple striking assembly 40 upward.

Figure 6:
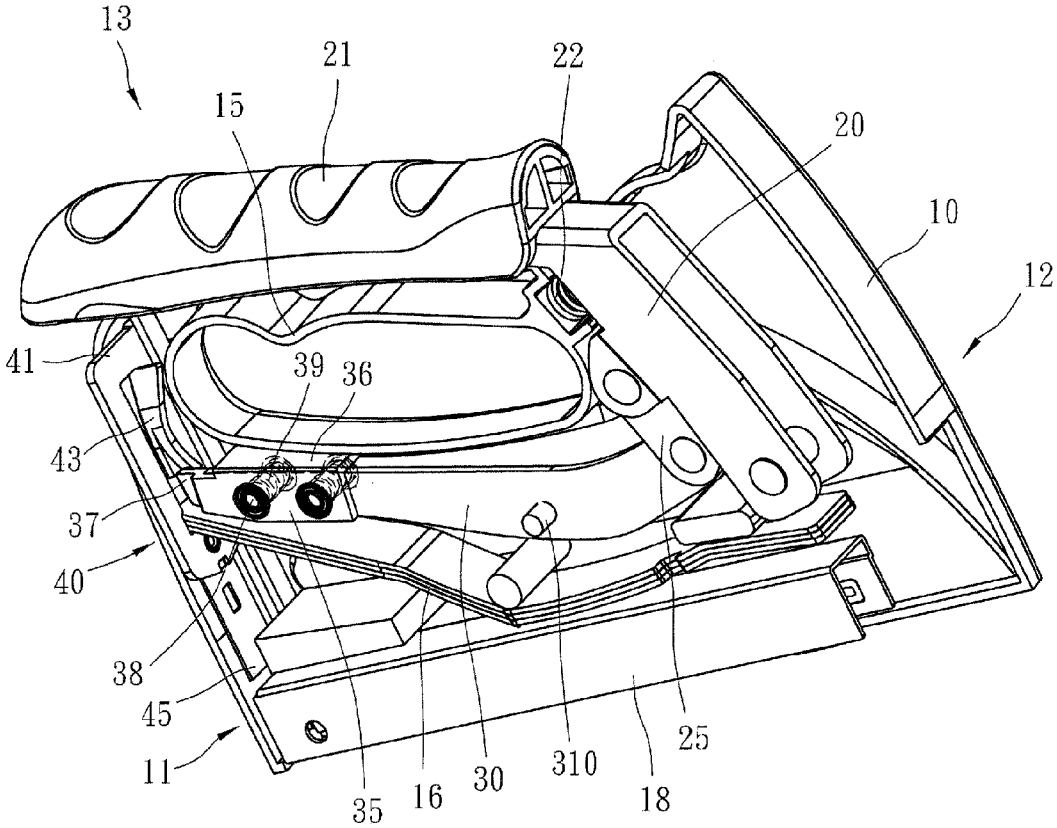
FIG. 6 is a perspective view, partially broken, showing the depressing bar depressed and the staple striking assembly raised.
Figure 7:
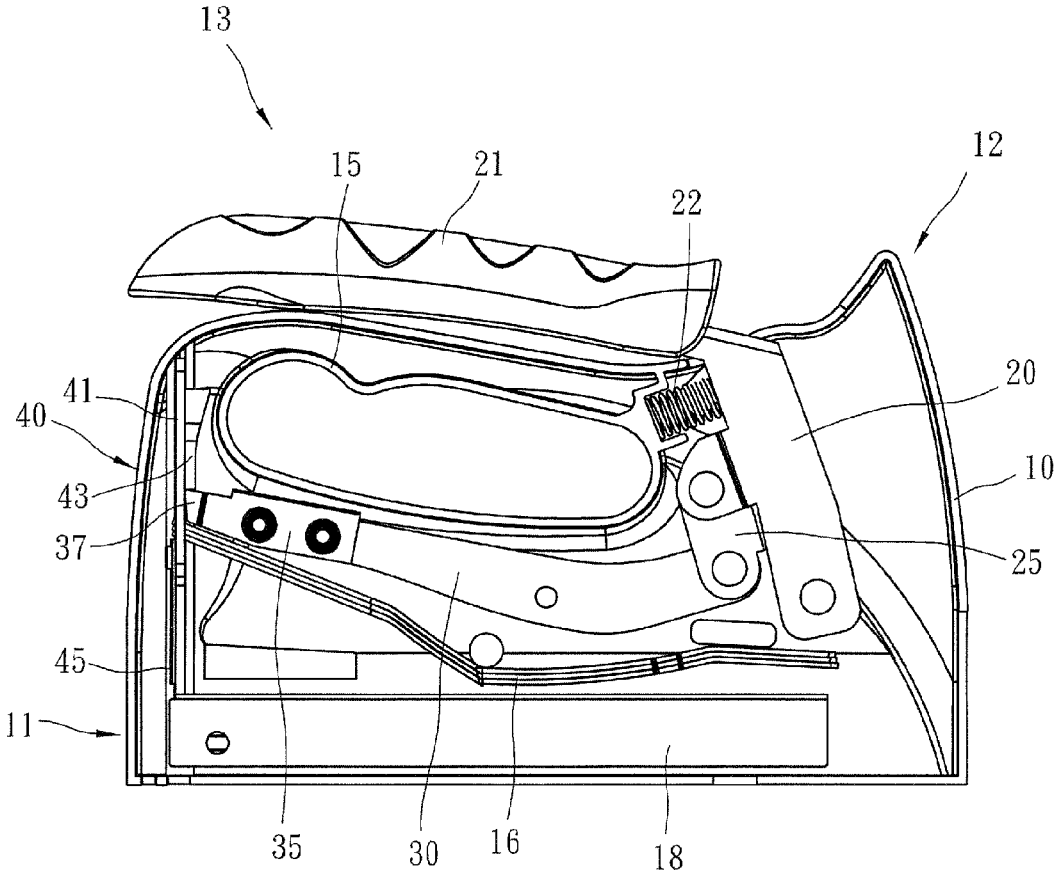
FIG. 7 is a cross-sectional view showing the depressing bar depressed and the staple striking assembly raised.
Figure 8:
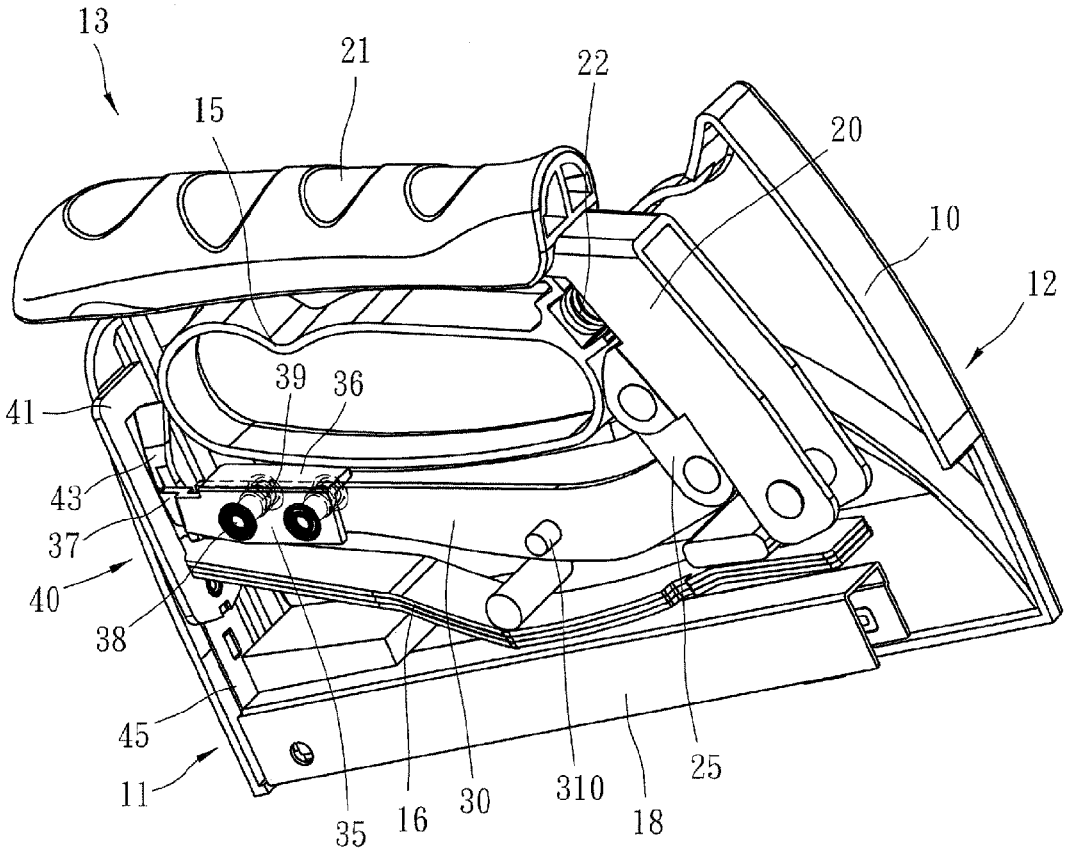
FIG. 8 is a perspective view, partially broken, showing the staple striking assembly released to drive a lower strike plate downward.
Figure 9:
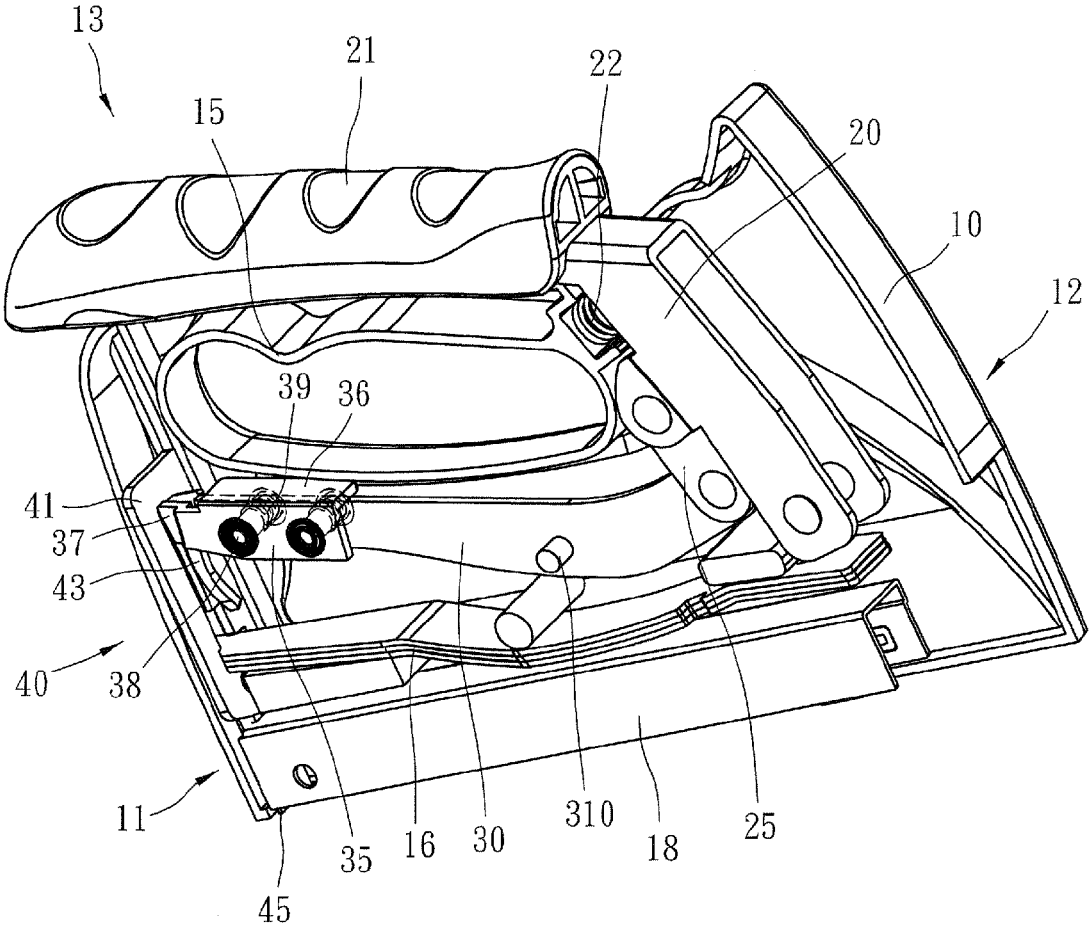
FIG. 9 is a perspective view, partially broken, showing the lower strike plate completely driven down to strike out a staple from the stapling device.

As shown in FIGS. 6 and 7, when the operator continuously depresses the depressing bar 20 down, the lifting member 35 raises the staple striking assembly 40 to a predetermined height level and the staple-striking spring plate 16 is simultaneously forced upward by the staple striking assembly 40, whereby a pre-loaded downward home-returning spring force is established in the staple-striking spring plate 16 and the staples loaded in the staple magazine 18 are allowed to move frontward to a location below the lower strike plate 45. Afterwards, as shown in FIG. 8, when the engaging piece 37 slides off the engaging end 431, the engaging piece 37 is guided by the guide flange 432 to move into the strike guide slot 42, causing the lifting member 35 to sideways shift and compressing the compression spring 39 to induce a pre-loaded home returning force. The staple striking assembly 40 is acted upon by the staple-striking spring plate 16 to strike downward (as shown in FIG. 9) to instantaneously and powerfully drive the staple that is moved to locate below the lower strike plate 45.

Figure 10:
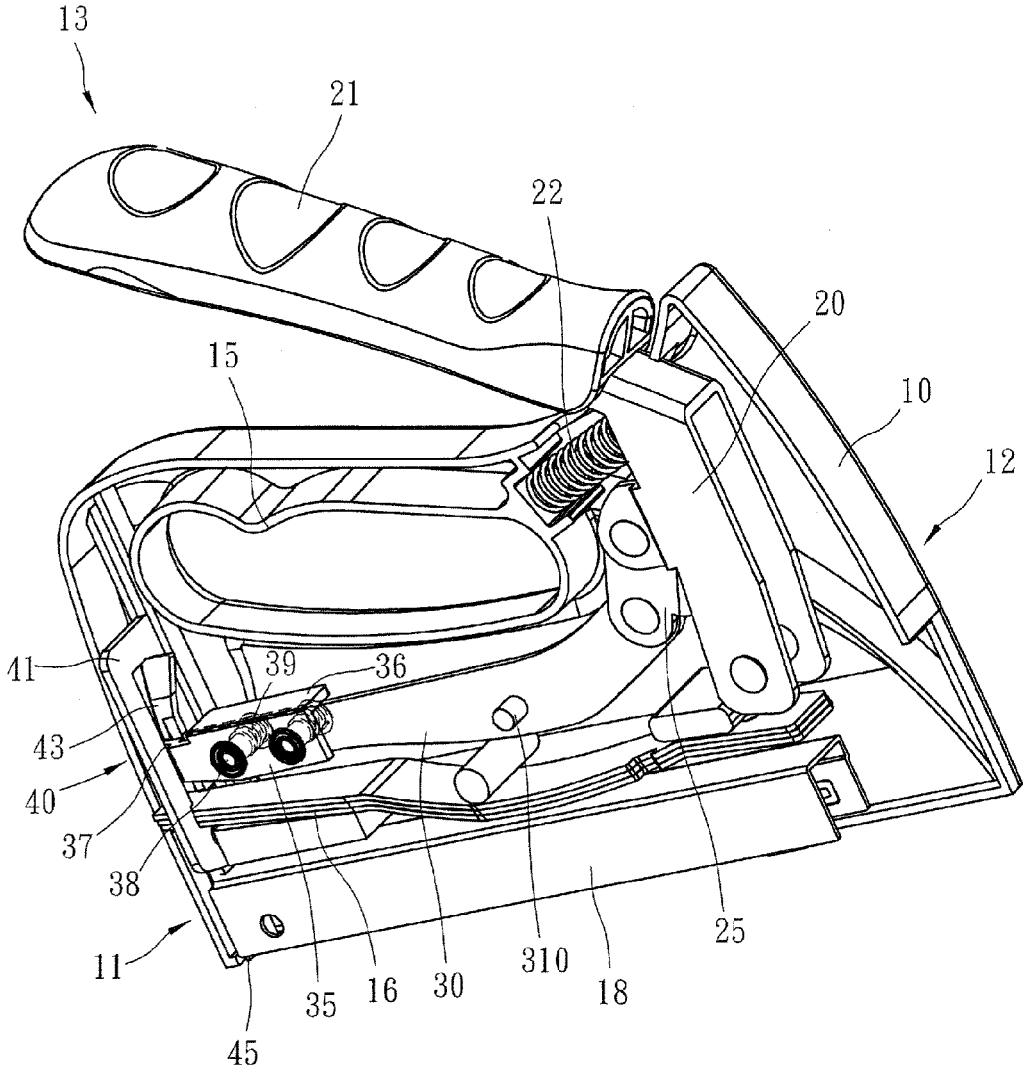
FIG. 10 is a perspective view, partially broken, showing the depressing bar and the staple striking assembly being moved to return to the home position.
Figure 11:
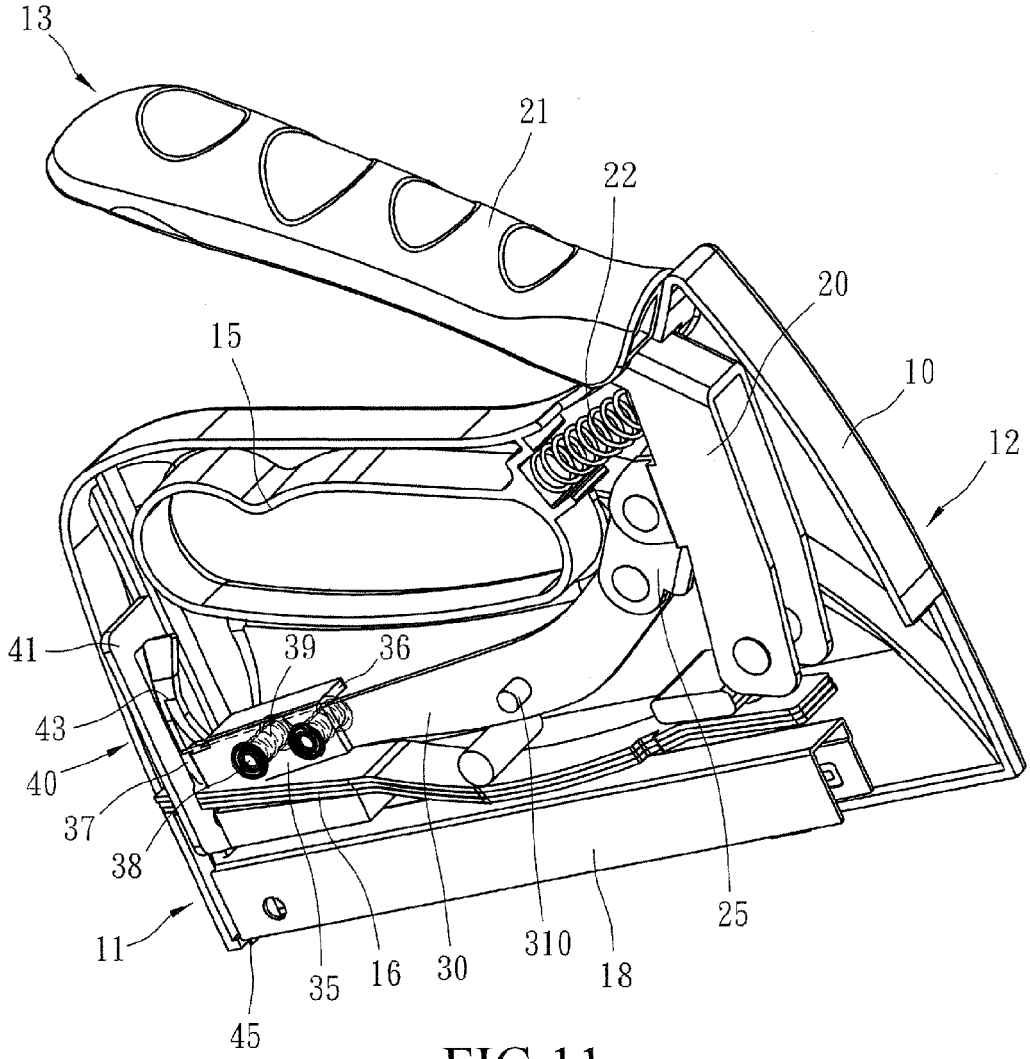
FIG. 11 is a perspective view, partially broken, showing the depressing bar and the staple striking assembly completely returned to home positions, ready for the next strike.

As shown in FIG. 10, the operator releases the depressing bar 20 and the depressing bar 20 is acted upon by the resilient element 22 to return to the home position. As shown in FIG. 11, the coupling end 33 is caused to move downward for home returning and in turn moves the engaging piece 37 downward along the strike guide slot 42. Due to the returning force provided by the compression spring 39, the engaging piece 37 automatically return to be positioned against the bottom of the engaging end 431, ready for the next strike.

Since in the present invention, the depressible portion of the depressing bar 20 is on the same side as the staple striking location of the staple striking assembly 40, the situation where the staple outlet is raised up will not occur, so that operation stability of the stapling device is enhanced and the performance of staple striking is improved, leading to enhanced convenience and safety of stapling operation. Further, the parts of the device according to the present invention can be formed in a single process by means of stamping, and the structure is greatly simplified, so that the manufacturing and the assembling are both simplified. Further, due to the presence of the guide board 43 that guides the movement of the lifting member 35, overall smoothness and reliability of the staple striking operation are improved.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A front-depression stapling device comprising a device body, a depressing bar pivotally mounted to the device body, a link plate driven by the depressing bar, and a staple striking assembly that is liftable and releasable by the link plate, wherein:

the device body has two ends respectively forming a staple striking end and a coupling end, the device body comprising a depressing end on the same side of the staple striking end, the device body receiving therein a staple-striking spring plate that has a free end inserted into and engaging the staple striking assembly, the device body having a lower portion receiving therein a selectively removable and replaceable staple magazine in which staples are loaded;

the depressing bar is pivotally mounted inside the coupling end of the device body, the depressing bar having a top portion forming a depressing section extending toward the depressing end of the device body, a resilient element being arranged between the depressing bar and the device body, the depressing bar being pivotally connected to a press-down seat, the press-down seat having an opposite end that is pivotally connected to the link plate;

the link plate is pivotally mounted to the device body, the link plate having and end to which a lifting member is provided for selectively engaging and moving the staple striking assembly, the lifting member being transversely movable with respect to a side surface of the link plate and automatically returnable to a home position, the lifting member having an end forming an engaging piece; and the staple striking assembly comprises an upper strike plate that is vertically movable inside the staple striking end of the device body, the upper strike plate forming a strike guide slot extending vertically along a central axis of the upper strike plate, the upper strike plate forming a guide board that is bent sideway on a side of the strike guide slot, the guide board having a lower end forming an engaging end that is engageable with the engaging piece of the lifting member, the guide board being connected to a guide flange that corresponds to the strike guide slot above the engaging end, the upper strike plate having a lower end to which a lower strike plate that is selectively extendable out of a lower end of the device body is mounted;

wherein when in use, the depressing section is depressed down toward the device body, the depressing bar depresses the pivoting end of the link plate thereby making the lifting member upward raised; and when the depressing bar is continuously depressed down, the lifting member raises the staple striking assembly to a predetermined height level and the staple-striking spring plate is simultaneously forced upward by the staple striking assembly, and when the engaging piece slides off the engaging end of the upper strike plate, the engaging piece is guided by the guide flange of the upper strike plate to move into the strike guide slot of the upper strike plate thereby causing the lifting member to shift sidways, and therefore causing the staple-striking spring plate to act upon the staple striking assembly to strike downward to drive a staple located below the lower strike plate.

2. The front-depression stapling device according to claim 1, wherein the device body has an upper portion forming a handle corresponding to the depressing end.

3. The front-depression stapling device according to claim 1, wherein the depressing bar forms a pivotal connection lug and wherein opposite ends of the press-down seat are respectively and pivotally connected to the pivotal connection lug and the link plate by pivot pins.

4. The front-depression stapling device according to claim 1, wherein the link plate forms a pivot hole that receives a shaft to pivotally mount inside the device body.

5. The front-depression stapling device according to claim 1, wherein the link plate and the lifting member respectively form at least two through holes that correspond to each other, the corresponding through holes receiving therethrough guide rods having a length greater than addition of thickness of the link plate and the lifting member, the guide rods being respectively fit in a compression spring at a side of the link plate opposite to the lifting member so that the engaging piece of the lifting member, after transversely moved, is provided with a returning force to re-position against the link plate.

6. The front-depression stapling device according to claim 5, wherein the lifting member forms a positioning tab positioned on the link plate.

7. The front-depression stapling device according to claim 5, wherein the engaging piece of the lifting member is formed by being bent to correspond to an axis of the link plate.

8. The front-depression stapling device according to claim 1, wherein the lifting member forms a positioning tab positioned on the link plate.

9. The front-depression stapling device according to claim 1, wherein the engaging piece of the lifting member is formed by being bent to correspond to an axis of the link plate.

10. The front-depression stapling device according to claim 1, wherein the guide board of the upper strike plate of the staple striking assembly forms a give-way flange above the guide flange.

* * * * *